US007885415B2

(12) United States Patent
Breitbach et al.

(10) Patent No.: US 7,885,415 B2
(45) Date of Patent: Feb. 8, 2011

(54) DEVICE AND METHOD FOR REDUCING SOUND OF A NOISE SOURCE IN NARROW FREQUENCY RANGES

(75) Inventors: Harald Breitbach, Goettingen (DE); Christian Gerner, Sande (DE); Delf Sachau, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 1529 days.

(21) Appl. No.: 11/213,424

(22) Filed: Aug. 26, 2005

(65) Prior Publication Data

US 2006/0067537 A1 Mar. 30, 2006

Related U.S. Application Data

(60) Provisional application No. 60/646,282, filed on Jan. 24, 2005.

(30) Foreign Application Priority Data

Aug. 26, 2004 (DE) ..... 10 2004 041 214

(51) Int. Cl.
*H04R 29/00* (2006.01)

(52) U.S. Cl. ..... 381/59; 381/96; 381/71.2; 381/71.7

(58) Field of Classification Search ..... 381/71.1–71.14, 381/95, 96, 121, 59
See application file for complete search history.

(56) References Cited

U.S. PATENT DOCUMENTS

| | | | | |
|---|---|---|---|---|
| 4,417,098 | A * | 11/1983 | Chaplin et al. | 381/71.12 |
| 4,562,589 | A | 12/1985 | Warnaka et al. | |
| 4,710,656 | A * | 12/1987 | Studer | 310/51 |
| 5,404,409 | A * | 4/1995 | Nagami et al. | 381/71.8 |
| 5,423,658 | A * | 6/1995 | Pla et al. | 415/118 |
| 5,621,656 | A * | 4/1997 | Langley | 700/280 |
| 5,954,169 | A * | 9/1999 | Jensen | 188/378 |
| 6,373,956 | B1 * | 4/2002 | Varla et al. | 381/353 |
| 2005/0031132 | A1 * | 2/2005 | Browning et al. | 381/59 |

FOREIGN PATENT DOCUMENTS

| | | |
|---|---|---|
| DE | 28 14 093 B1 | 8/1979 |
| DE | 33 44 910 A1 | 6/1984 |
| DE | 198 36 483 A1 | 2/2000 |
| GB | 2019695 | 10/1979 |

* cited by examiner

*Primary Examiner*—Vivian Chin
*Assistant Examiner*—Jason R Kurr
(74) *Attorney, Agent, or Firm*—Christopher Paradies; Fowler White Boggs P.A.

(57) ABSTRACT

The present application relates to a sound reduction device as well as to a corresponding method. The sound reduction device comprises a sound pickup for measuring an occurring error signal of a primary sound wave of the noise source and of a secondary sound wave of a narrow-band electroacoustic transducer. This error signal may be transmitted to a control unit, which receives a reference signal of the noise source and generates a control signal which is adapted to change the mechanical values of the electroacoustic transducer.

16 Claims, 4 Drawing Sheets

DEVICE AND METHOD FOR REDUCING SOUND OF A NOISE SOURCE IN NARROW FREQUENCY RANGES

CROSS REFERENCE TO RELATED APPLICATIONS

This application claims the benefit of the filing date of German Patent Application No. 10 2004 041 214.6 filed Aug. 26, 2004 and of U.S. Provisional Application No. 60/646,282 filed Jan. 24, 2005, the disclosure of which is hereby incorporated herein by reference.

FIELD OF THE INVENTION

In general, the field relates to noise reduction of acoustics. In particular, the invention relates to a device, which is adapted to reduce sound of a noise source by superpositioning sound waves. Apart from that, the invention relates to a corresponding method, which is adapted to reduce sound of a noise source by superpositioning sound waves. In particular, the present invention may be used with aircraft cabins, using electroacoustic transducers for generating sound waves as counter-sound.

TECHNOLOGICAL BACKGROUND

A well-known apparatus for reducing sound is based on a single static loudspeaker arrangement which is not adapted to be regulated depending on the occurring sound to be reduced. Rather, that apparatus generates a broad-band counter-sound which cannot be controlled. Such designs having broad-band counter-sound devices make it possible to reduce noise by about 6 dB but have poor efficiency since they are not self-regulating. Moreover, such devices are heavy and often have relatively large loudspeaker arrangements. By having such feature they are not suitable for use in all fields of application, such as, for example, for a use in an aircraft. Such well-known methods for generating counter-sound for noise reduction are based on individual components which are not attuned to the frequency to be generated but to broad-band transmission behaviour. Hence, these methods do not provide reasonable efficiency for a narrow-band field of application such as, for example, for active reduction of a propeller noise, wherefore it is necessary to use amplifiers with considerable electrical input. However, such amplifiers are quite heavy and thus disadvantageous in mobile applications as, for example, in the field of aviation.

SUMMARY OF THE INVENTION

It is an object of the present invention to provide a realization for noise reduction using a narrow-band electroacoustic energy transducer, which provides an adjustable and active noise abatement by an adaptation to existing circumstances and which ensures low-expenditure implementation for mobile applications as, for example, in the field of aviation.

According to a first example of the present invention, a device for reducing sound of a noise source generating a primary sound wave in narrow frequency ranges which attains the sound reduction by superpositioning the primary sound wave with a secondary sound wave to be generated. The inventive sound reduction device comprises an electroacoustic transducer generating the secondary sound wave wherein the electroacoustic transducer has definitive mechanical values. Moreover, the sound reduction device comprises at least one sound pickup as well as a control unit.

At least one sound pickup is set up to measure an error signal of the primary sound wave and of the secondary sound wave. Such an error signal will occur in case that the secondary sound wave will not completely wipe out the primary sound wave generated by the noise source. To improve the noise reduction in case that the primary sound wave is not completely wiped out, the error signal will be transmitted to the control unit wherefore at least sound pickup may be coupled to the control unit. On the one hand, the control unit receives that error signal and on the other hand, the control unit is arranged to receive a reference signal representative for the primary sound wave of the noise source. The control unit is set up to generate a control signal for changing the mechanical values of that electroacoustic transducer on the basis of the reference signal and the error signal.

In other words, the sound pickup measures an occurring error signal of a primary sound wave of the noise source and of a secondary sound wave of a narrow-band electroacoustic transducer, which error signal will be conveyed to the control unit which apart from that receives a reference signal of the noise source to generate a control signal for changing the mechanical values of the transducer. By means of an adaptation of the mechanical values of the transducer as, for example, of the spring stiffness of the membrane suspension, the parameters of the secondary sound wave as, for example, the frequency may be adjusted.

To change the mechanical values of the transducer, the electroacoustic transducer comprises, for example, means for changing the spring stiffness of its membrane suspension. In particular, the electroacoustic transducer comprises a suspended membrane having a spring stiffness and adjustment means, which are arranged to change the spring stiffness of the suspended membrane. For example, the spring stiffness of the suspended membrane may be adjusted by designing the membrane suspension as an active foil showing an piezoelectric effect when energized with a voltage. Alternatively, the spring stiffness can by adjusted by changing a radial length of the membrane suspension between the membrane and the corresponding bearing surface. Another possibility to change the spring stiffness may be achieved by adjusting the volume of an housing in which the membrane is suspended. Such an volume adjustment will result in an indirect change of the spring stiffness since the membrane has to compress less air when the volume of the housing is increased for example.

When the electroacoustic transducer is a flat-core loudspeaker for example, the spring stiffness may be adjusted by applying a voltage to a plurality of piezoelectric elements incorporated into the membrane plate, wherein the piezoelectric elements will stiffen the membrane plate. Also, the spring stiffness may be adjusted when varying the distance between the bearings bridged by the membrane. As illustrated before, the spring stiffness may be adjusted by changing the volume of the loudspeaker housing. Still another possibility to change the value of the spring stiffness may be achieved by prestressing the membrane plate and adjusting the prestress depending on the required value of the spring stiffness.

By attuning the mechanical characteristics of the electroacoustic transducer in conjunction with attuning a resonant electrical circuit, it becomes possible to attune a pre-defined operating frequency. Adapting the mechanical and electrical parameters makes it possible to adjust the characteristics during operation.

Furthermore, it is proposed that the electroacoustic transducer be drivable by way of a resonance amplifier, and that for the purpose of setting an operating frequency o the sound reduction device way of the control unit, the resonant circuit that is created may be adapted by way of an adjustable capacity. For these purposes the electroacoustic transducer in combination with that resonance amplifier make up a resonant circuit comprising an adjustable capacity which is controlled by the control unit to set an operating frequency of the electroacoustic transducer.

To improve the relationship between the parameters of the primary sound wave and the secondary sound wave it is proposed to control the control unit by means of an acquired velocity signal of the membrane of the electroacoustic transducer and/or by an output signal of the resonance amplifier. In turn, the control unit can control the spring stiffness of the suspended membrane and/or the capacity of the resonant circuit so that an adaptation of the parameters of the secondary sound wave as, for example, amplitude, phase shift and frequency may be attained. For that purpose, the control unit comprises a memory unit storing the parameters to be controlled depending on the error signal.

According to another example of the present invention, a method is provided which is adapted to reduce sound of a noise source generating a primary sound wave in narrow frequency ranges by superpositioning secondary sound waves as counter-sound. The inventive sound reduction method generates a secondary sound wave by means of an electroacoustic transducer, which has definite mechanical values. To register whether or not the sound reduction was satisfactory, an error signal will be detected by a comparison of the parameters of the primary sound wave and of the secondary sound wave. In case that the primary sound wave is not satisfactorily wiped out by the secondary sound wave or exceeds a predetermined threshold value, the error signal may be used by a control unit to adjust the electroacoustic transducer. Therefore, the error signal is transmitted to the control unit, which in turn generates a control signal for changing the mechanical values, as for example, the spring stiffness of the electroacoustic transducer on the basis of a reference signal of the noise source and the error signal.

Furthermore, it is proposed that the electroacoustic transducer is arranged to be driven by a resonance amplifier. That amplifier in combination with the electroacoustic transducer makes up a resonant circuit comprising an adjustable capacity which is controlled by the control unit.

Moreover, to optimize the sound reduction attained by means of the sound reduction method, a velocity signal of a membrane of that electroacoustic transducer and/or an output signal of that resonance amplifier may be registered to regulate the control unit. In turn, the control unit can control a spring stiffness of the membrane and/or the capacity of the resonant circuit.

For this purpose, the control unit stores the parameters to be controlled depending on the error signal, and in particular depending on the frequency, on the frequency shift as well as on the amplitude difference between the primary sound wave and the secondary sound wave.

According to still another example of the present invention, it is proposed to use the sound reduction device comprising at least some of the features illustrated above in an aircraft cabin in order to reduce the sound of a noise source as, for example, a propeller generating a primary sound wave in a narrow frequency range.

BRIEF DESCRIPTION OF THE DRAWINGS

In the following, the present invention will be illustrated by reference to the attached drawings which merely depict the present invention by way of exemplary embodiments which are not intended to limit the scope of protection which is only defined by the attached claims.

DETAILED DESCRIPTION OF EXEMPLARY EMBODIMENTS

This detailed description provides specific examples, and the present invention should not be limited merely to the examples disclosed. Instead, the invention should be limited only by the claims that may eventually issue. Many variations in the system, changes in specific components of the system and uses of the system will be readily apparent to those familiar with the area based on the drawings and description provided.

Figure 1:
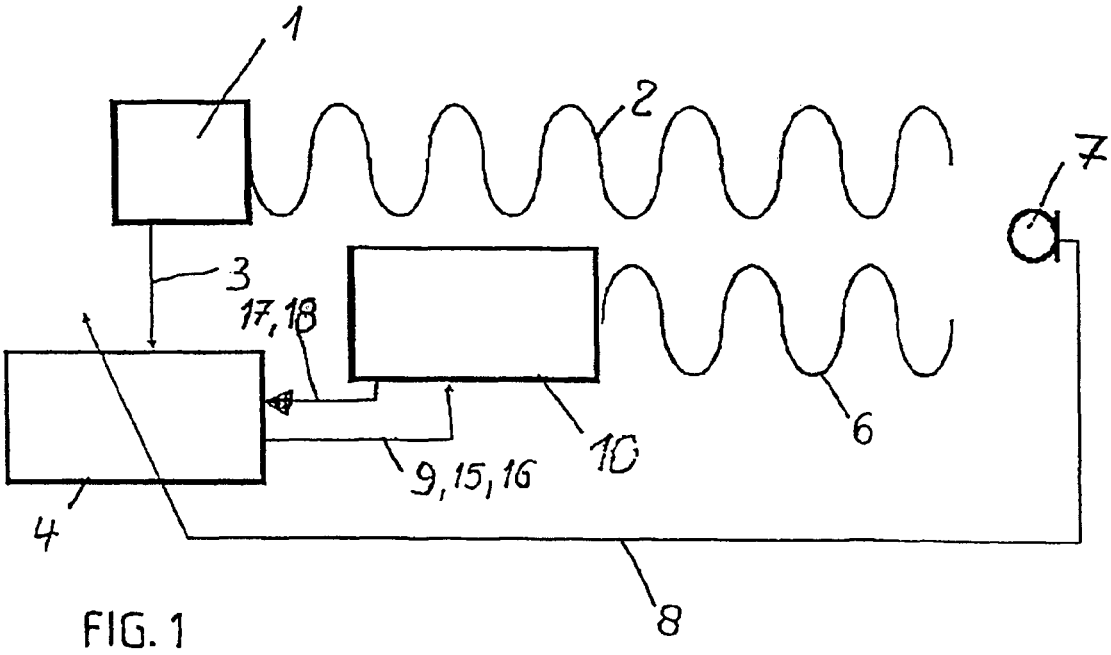
FIG. 1 shows a schematic diagram of an overall system.

Referring to FIG. 1, a schematic diagram of an overall system of an exemplary embodiment of a sound reduction device is illustrated. FIG. 1 shows a noise source 1 as, for example, a propeller of an aircraft generating, for example, sinusoidal sound waves 2. At the same time, a reference signal 3 being representative for the sound wave 2 is conveyed to control unit 4. Control unit 4 causes an electroacoustic transducer 5 comprising an amplifier 10 such as a mechatronic loudspeaker to generate a secondary sound wave 6, which will be superpositioned on the primary sound wave 2. Herein, the secondary sound wave 6 will be displaced by 180°, and have the same amplitude and frequency as the primary sound wave 2 so that in an ideal case secondary sound wave 6 will wipe out the primary sound wave 2.

Normally however, in a first clock cycle, secondary sound wave 6 will not match primary sound wave 2 properly. Therefore, the residual noise will be registered by error microphone 7 and the resulting error signal will be transmitted to the control unit 4 in order to bring the residual noise towards zero. This will be achieved by a secondary signal 9 generated and determined by control unit 4, which has the same frequency but deviating amplitude and phase as the conveyed reference signal 3. Electroacoustic transducer 5 will receive the secondary signal 9 in order to transform that signal in a second clock cycle into a secondary sound wave 6 as a counter-sound wave. By this transformation of secondary signal 9 into a secondary sound wave 6 an amplitude and phase change will result due to the transformation of secondary signal 9 to the secondary sound wave 6. This amplitude and phase change will be taken into consideration by control unit 4 during the generation of the secondary signal 9.

Figure 2:
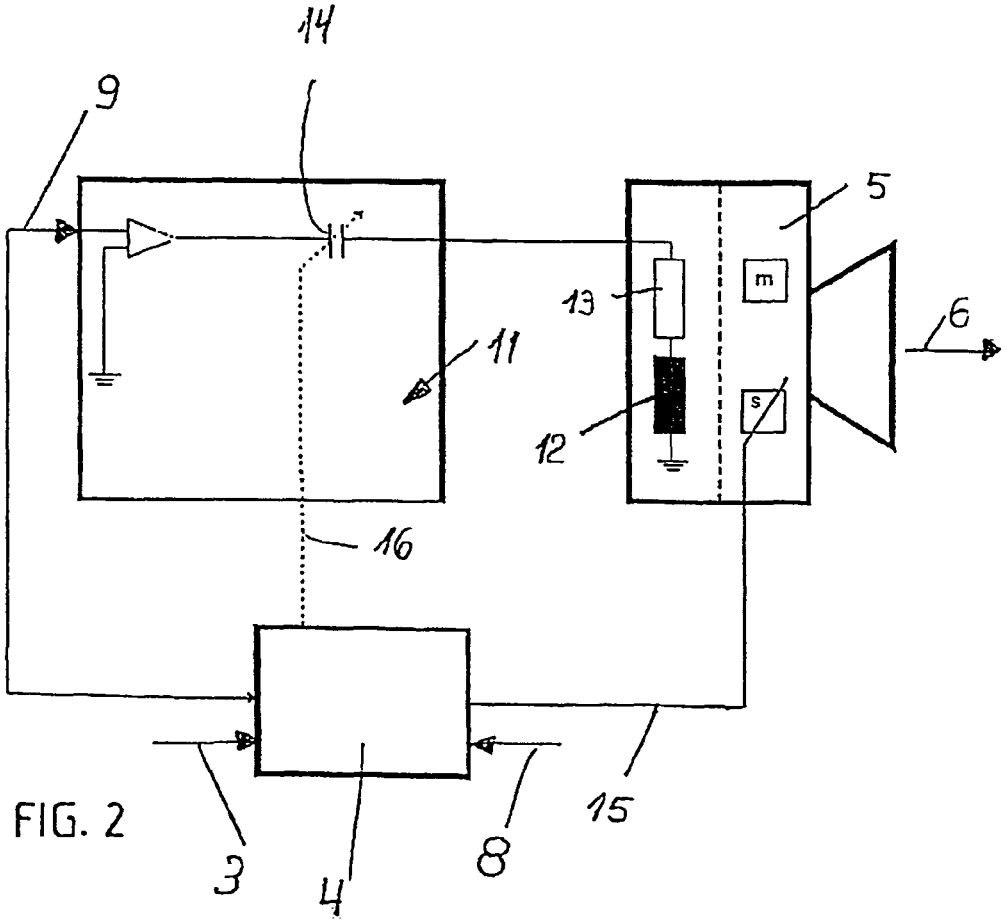
FIG. 2 shows a first embodiment of an exemplary sound reduction device.

Referring to FIG. 2, a first concrete exemplary embodiment of an inventive sound reduction device is depicted. The sound reduction device depicted in FIG. 2 comprises an electroacoustic transducer 5, which receives a mono-frequent input signal 9 (secondary signal) from control unit 4 via a resonance amplifier 11. Input signal 9 (secondary signal) is fed into a serial electrical resonant circuit, which is made up of components of the electroacoustic transducer 5 and components of the resonance amplifier 11. In particular, this resonant circuit is made up of an inductance 12 and an resistor 13 of electroacoustic transducer 5 as well as of capacity 14 of resonance amplifier 11. Herein, the resonance frequency of that resonant circuit may be set according to the desired operating frequency, which depends on the frequency of the primary sound wave 2.

The electroacoustic transducer 5 transforms the amplified secondary signal 9 into the already mentioned secondary sound wave 6 having the same frequency as the secondary input signal 9. Hence, the electroacoustic transducer 5 is attuned such that the resonance frequency of the transducer 5 corresponds to the desired operating frequency of the system, which is dictated by the primary sound wave generated by a propeller, for example.

Control unit 4 receives reference signal 3 and determines the frequency of that reference signal 3. If the determined frequency does not match the set frequency of the system, control unit 4 changes the parameters of electroacoustic transducer 5. For example, control unit 4 may adjust the spring stiffness of the membrane suspension by way of a control signal 15. Herein, the parameters to be set may be stored in a memory unit of the control unit 4. For example, the parameters to be set depending on the frequency may be deposited in that memory unit of the control unit 4.

In case, that it should be necessary to adjust the parameters of resonant circuit 14, 13, 12, control unit 4 will generate a control signal 16 by means of which the value of capacity 14 may be adjusted.

Figure 3:
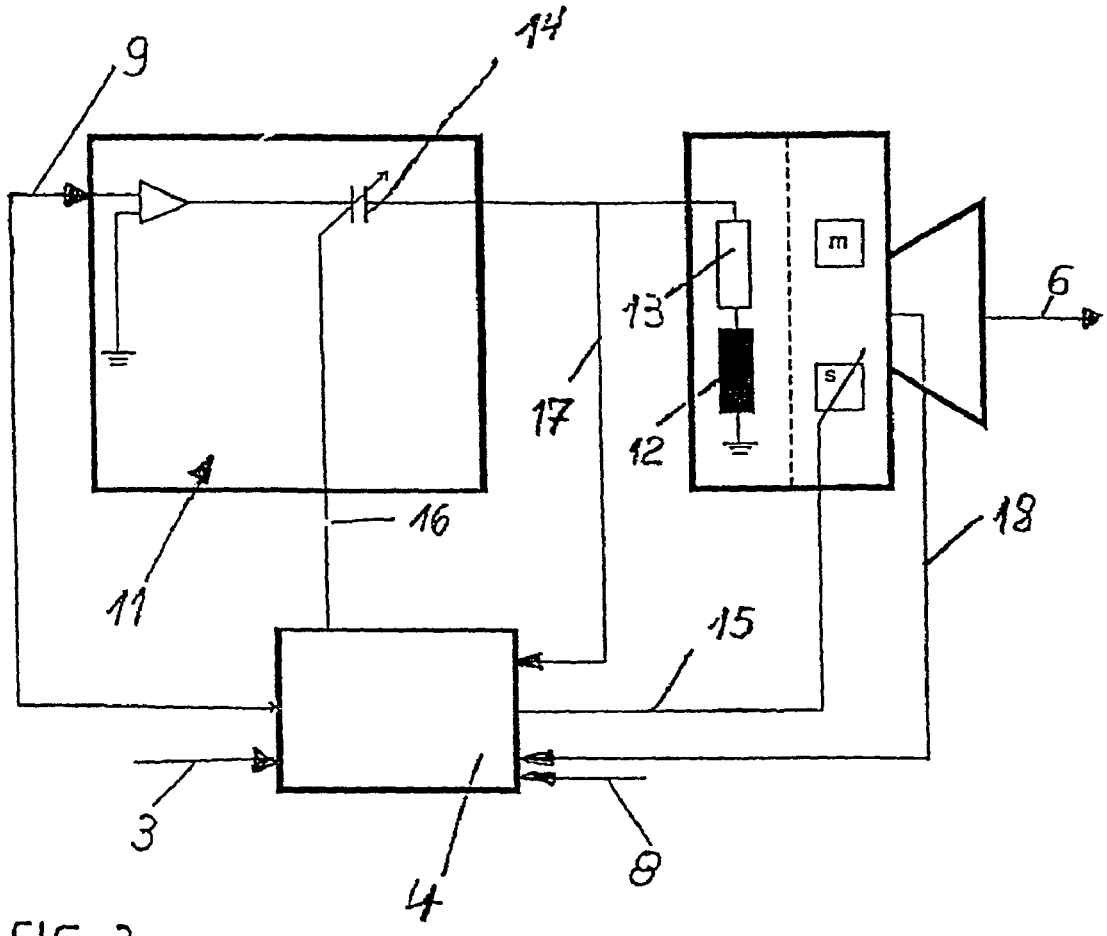
FIG. 3 shows a second embodiment of an exemplary sound reduction device.

Referring to FIG. 3, a further embodiment of an inventive sound reduction system will be illustrated. In contrast to the device depicted in FIG. 2, the regulating device of FIG. 3 is adapted to optimize the efficiency of the overall system. For this purpose, control device 4 additionally receives an output signal 17 from resonance amplifier 11 and, by way of a velocity pickup taken at the membrane of the electroacoustic transducer 5 a velocity signal 18, which is representative for the velocity of the membrane of the electroacoustic transducer 5. On the basis of these signals, control unit 4 is in the position to check whether the parameters of the electroacoustic transducer 5 and of resonance amplifier 11 are set such that the efficiency of the overall system is optimized. For example, if the frequency of reference signal 3 representative for the primary sound wave changes or if the environmental conditions change, the efficiency of the overall system will no longer be optimal wherefore control unit 4 will change the parameters of transducer 4, for example, in the form of an adaptation of its spring stiffness of its membrane suspension by way of control signal 15 generated by control unit 4. The efficiency of the overall system may be optimized by control unit 4 based on signals 17, 18 by changing the parameters of the electrical resonant circuit 14, 13, 12 by means of an adaptation of the value of capacity 14 via control signal 16.

Figure 4:
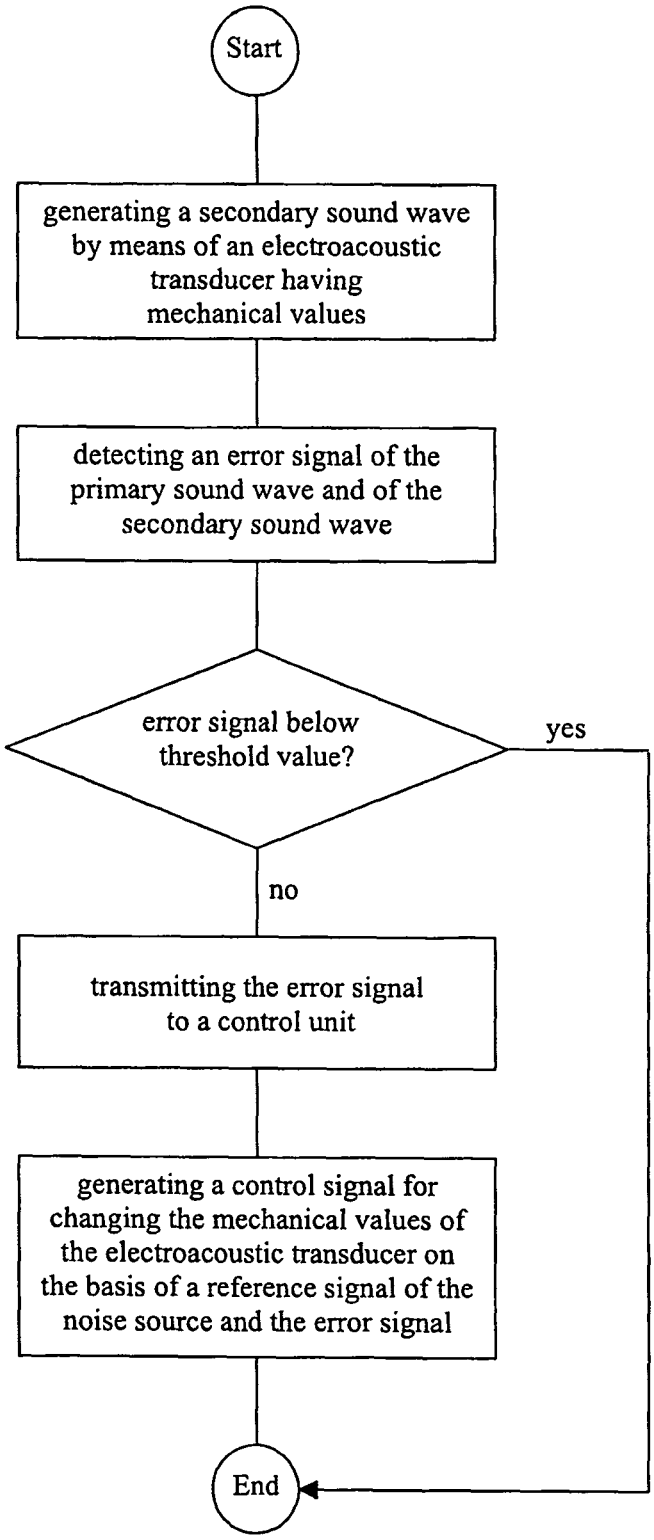
FIG. 4 shows a flow-chart illustrating the inventive method.

Referring to FIG. 4, the inventive sound reducing method will be illustrated by way of a flow-chart. Although the individual steps are shown in FIG. 4 in a certain order, they need not compulsory performed in the illustrated order. In a first step, the method for reducing sound of a noise source generating a primary sound wave by superpositioning sound waves generates a secondary sound wave will be generated as a counter-sound by means of an electroacoustic transducer 5 having definite mechanical values. The generation of a secondary sound wave may be controlled by a control unit 4 in a first clock cycle with a given frequency. In a subsequent step, the reminder of the primary sound wave and the secondary sound wave, if any, may be detected in form of an error signal by means of a sound pickup 7, for example. In case that the error signal falls below a predetermined threshold value, the method will terminate. However, in case that that error signal exceeds a said threshold value which might be adjustable, the error signal will be transmitted to a control unit 4 afterwards which is adapted to optimize the mechanical values of the electroacoustic transducer in order to reduce the reminder sound of primary sound wave and secondary sound wave. For this purpose, control unit 4 may generate a control signal, which is adapted to change the mechanical values of the electroacoustic transducer on the basis of a reference signal of the noise source and the received error signal.

Figure 5:
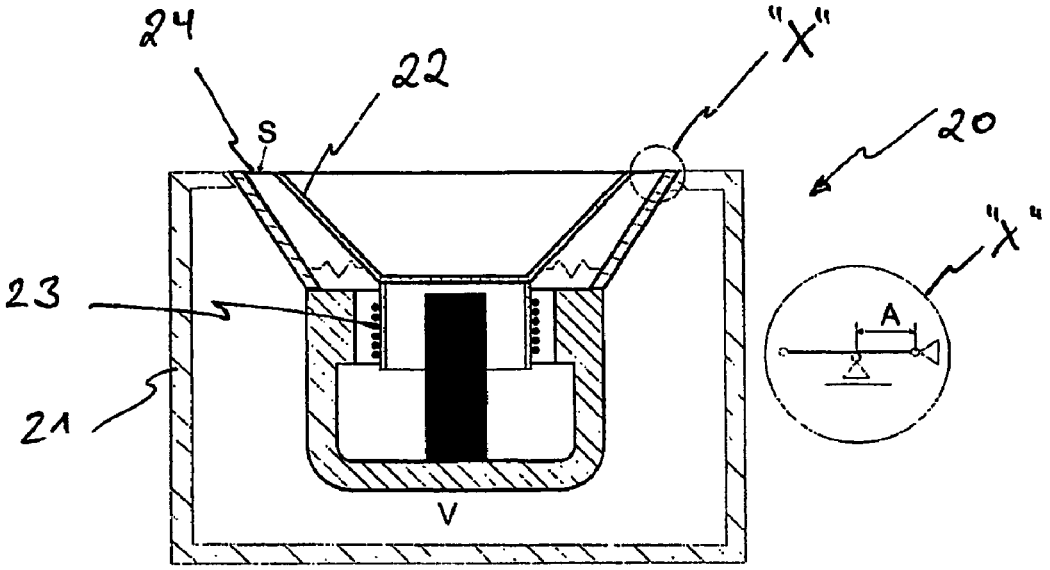
FIG. 5 illustrates means for changing the spring stiffness of an cone loudspeaker.
Figure 6:
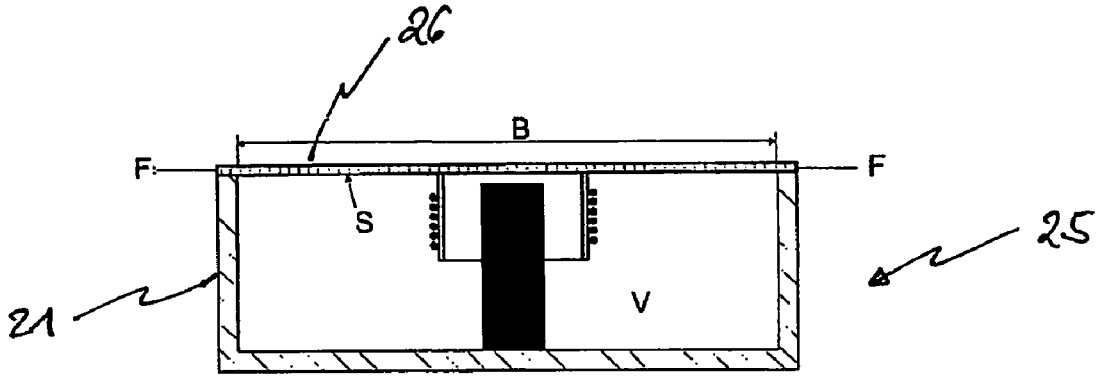
FIG. 6 illustrates means for changing the spring stiffness of an flat-core loudspeaker.

Referring to FIGS. 5 and 6 diverse possibilities of adjustment means for changing the spring stiffness of an electroacoustic transducer are illustrated. Referring to FIG. 5, a cone loudspeaker is shown by reference numeral 20 comprising a housing 21 and a membrane 22 oscillating in an front opening of housing 21. Membrane 22 is driven by moving coil 23 and is suspended in the font opening of hosing 21 via membrane suspension 24, the spring stiffness S of which shall be adjusted. One possibility to adjust said spring stiffness S is to design the membrane suspension as an active foil showing an piezoelectric effect when energized with an voltage. For example, membrane suspension 24 may be made up of PVDF which shows a piezoelectric behaviour when energized. Alternately, the spring stiffness S can by adjusted by changing a radial length A of the membrane suspension between the membrane and the corresponding bearing surface in the front opening in housing 21. For example, a bearing ring may by provided, which changes its diameter by actuating piezoelectric elements incorporated in said bearing ring. Here, the membrane suspension may form a leaf spring element mounted inwardly on said bearing ring. Another possibility to change the spring stiffness may be achieved by adjusting the volume V of housing 21 in which membrane 24 is suspended. Such a volume adjustment will result in an indirect change of the spring stiffness S since the membrane has to compress less air when the volume of the housing is increased for example.

Referring to FIG. 6 the spring stiffness adjustment shall be illustrated with reference to an flat-core loudspeaker 25. FIG. 5 shows a flat-core loudspeaker 25 comprising a housing 21 and a membrane plate 26 sealing and oscillating in a front opening of housing 21. The spring stiffness S of such a flat-core loudspeaker 25 may be adjusted by incorporation of a plurality of piezoelectric elements as for example PZT-elements into membrane plate 26 and by applying an voltage to said plurality of piezoelectric elements so that the piezoelectric elements will stiffen membrane plate 26. Also, the spring stiffness S may be adjusted by a variation of the distance B between the bearings bridged by the membrane plate 26. For example, distance B between the bearings of membrane plate 26 may be varied by any kind of actuator means as for example thread rods (nor shown) displacing the side walls of housing 21. Alternately, spring stiffness S may be adjusted by changing the volume of loudspeaker housing 21 as mentioned above. Still another possibility to change the value of the spring stiffness S may be achieved by prestressing the membrane plate 26 with an prestress force F an adjusting the prestress force F depending on the required value of the spring stiffness S.

It will be understood that both the inventive sound reduction device as well as the corresponding method is suitable for use with aircraft applications. In particular, the individual components which are necessary to constitute the inventive sound reduction device are quite lightweight, wherefore the device is adapted for use with aviation applications.

It should be noted that the term "comprising" does not exclude other elements or steps and the "a" or "an" does not exclude a plurality. Also elements described in association with different embodiments may be combined.

The invention claimed is:

1. A device for reducing sound of a noise source generating a primary sound wave in narrow frequency ranges by superpositioning sound waves, comprising:

an electroacoustic transducer generating a secondary sound wave, the electroacoustic transducer comprising a suspended membrane having a spring stiffness and an adjustment mechanism capable of changing the spring stiffness of the suspended membrane;

at least one sound pickup;

a control unit;

wherein said at least one sound pickup is set up to measure an error signal of the primary sound wave and of the secondary sound wave;

wherein said at least one sound pickup is coupled to said control unit to transmit the error signal to said control unit;

wherein said control unit is arranged to receive a reference signal of the noise source and is coupled to the adjustment mechanism of said electroacoustic transducer such that the spring stiffness of the suspended membrane is changed on the basis of the reference signal and the error signal.

2. The sound reduction device according to claim 1, further comprising a resonance amplifier, wherein said electroacoustic transducer is driven by said resonance amplifier.

3. The sound reduction device according to claim 2, wherein said electroacoustic transducer in combination with said resonance amplifier make up a resonant circuit comprising an adjustable capacity which is controlled by said control unit to set an operating frequency.

4. The sound reduction device according to claim 2, wherein the control unit is controllable by an acquired velocity signal of the suspended membrane of said electroacoustic transducer.

5. The sound reduction device according to claim 4, wherein the control unit is controllable by an output signal of said resonance amplifier.

6. The sound reduction device according to claim 5, wherein said control unit is arranged to control the capacity of the resonant circuit in turn.

7. The sound reduction device according to claim 1, wherein said control unit comprises a memory unit storing parameters to be controlled depending on the reference signal of the noise source.

8. An aircraft cabin comprising the sound reduction device of claim 1 for reducing the sound of a noise source generating a primary sound wave in a narrow frequency range.

9. A method for reducing sound of a noise source generating a primary sound wave in narrow frequency ranges by superpositioning sound waves, comprising:

generating a secondary sound wave by means of an electroacoustic transducer, the electroacoustic transducer comprising a suspended membrane having a spring stiffness and adjustment mechanism capable of changing the spring stiffness;

detecting an error signal of the primary sound wave and of the secondary sound wave; transmitting the error signal to a control unit;

generating a control signal for changing the spring stiffness of the suspended membrane of the electroacoustic transducer on the basis of a reference signal of the noise source and the error signal; and changing the spring stiffness of the suspended membrane based on the control signal generated in the step of generating.

10. The sound reducing method of claim 9, further comprising driving the electroacoustic transducer using a resonance amplifier.

11. The sound reducing method of claim 10, further comprising:

combining the electroacoustic transducer and the resonance amplifier to make up a resonant circuit providing an adjustable capacity; and controlling, with the control unit, the adjustable capacity of the resonant circuit in order to set an operating frequency.

12. The sound reducing method of claim 11, further comprising:

registering a velocity signal of the suspended membrane of said electroacoustic transducer; and regulating the control unit using the velocity signal registered during the step of registering.

13. The sound reducing method of claim 12, wherein said control unit in turn controls the spring stiffness of the suspended membrane in response to the step of regulating the control unit.

14. The sound reducing method of claim 12, wherein an output signal of said resonance amplifier is registered and the output signal is used in the step of regulating the control unit.

15. The sound reducing method of claim 14, wherein said control unit in turn controls the capacity of the resonant circuit.

16. The sound reducing method of claim 9, further comprising:

storing parameters to be controlled, depending on the error signal in the control unit.

* * * * *